US008376512B2

(12) United States Patent
Ito

(10) Patent No.: US 8,376,512 B2
(45) Date of Patent: Feb. 19, 2013

(54) DROPLET DISCHARGE DEVICE AND METHOD FOR CONTROLLING DROPLET DISCHARGE DEVICE

(75) Inventor: Yoshihiro Ito, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 251 days.

(21) Appl. No.: 12/883,452

(22) Filed: Sep. 16, 2010

(65) Prior Publication Data

US 2011/0096119 A1 Apr. 28, 2011

(30) Foreign Application Priority Data

Oct. 26, 2009 (JP) ..... 2009-245203
Mar. 3, 2010 (JP) ..... 2010-046143

(51) Int. Cl.
*B41J 23/00* (2006.01)
*B41J 29/393* (2006.01)

(52) U.S. Cl. ..... 347/37; 347/19

(58) Field of Classification Search ..... None
See application file for complete search history.

(56) References Cited

U.S. PATENT DOCUMENTS

2008/0088662 A1* 4/2008 Kojima ..... 347/19

FOREIGN PATENT DOCUMENTS

JP 2009-006212 A 1/2009

* cited by examiner

*Primary Examiner* — Geoffrey Mruk
(74) *Attorney, Agent, or Firm* — Global IP Counselors, LLP

(57) ABSTRACT

A droplet discharge device is adapted to perform drawing of droplets of functional liquid from a functional droplet discharge head onto a workpiece in a drawing area, and to perform discharge inspection of the functional droplet discharge head in an inspection area, which is separated from the drawing area. The droplet discharge device includes a positioning stage, a flushing unit and an inspection stage disposed in this order along a common movement axis passing through the drawing area and the inspection area so that the inspection stage is disposed at a position closer to the inspection area. An image recognition device is disposed in the inspection area. A movement mechanism is arranged to move the positioning stage, the flushing unit and the inspection stage along the common movement axis. The movement mechanism is arranged to move the inspection stage independently of the positioning stage and the flushing unit.

6 Claims, 10 Drawing Sheets

DROPLET DISCHARGE DEVICE AND METHOD FOR CONTROLLING DROPLET DISCHARGE DEVICE

CROSS-REFERENCE TO RELATED APPLICATIONS

This application claims priority to Japanese Patent Application No. 2009-245203 filed on Oct. 26, 2009 and Japanese Patent Application No. 2010-046143 filed on Mar. 3, 2010. The entire disclosures of Japanese Patent Application Nos. 2009-245203 and 2010-046143 are hereby incorporated herein by reference.

BACKGROUND

1. Technical Field

The present invention relates to a droplet discharge device and to a method for controlling a droplet discharge device, wherein drawing on a workpiece by a functional droplet discharge head and inspection of the functional droplet discharge head are performed along a common movement axis.

2. Related Art

An example known in the art of a droplet discharge device of such description is one in which discharge inspection of the functional droplet discharge head is performed while a workpiece is being placed or removed (see Japanese Laid-Open Patent Publication No. 2009-6212).

This droplet discharge device comprises an X-axis table for moving the workpiece set on a workpiece table in an X-axis direction, a Y-axis table provided so as to span across the X-axis table, and two carriage units mounted on the Y-axis table and having a plurality of functional droplet discharge heads. In addition to the workpiece table, a target unit for receiving inspection discharges from the functional droplet discharge head and a periodic flushing box for receiving flushing discharges (flushing) from the functional droplet discharge head are moveably mounted on the X-axis table, and a photography unit for performing image recognition of deposited dots that have been discharged for inspection on an inspection sheet is suspended from the guide rail portion of the Y-axis table.

A drawing area for discharging functional liquid and performing drawing is set up in a region where the X-axis table and the Y-axis table intersect, and an alignment position for aligning the workpiece or for placing and removing the workpiece is set up in a region separated in the X-axis direction from the drawing area. When the workpiece is moved to the alignment position via a setting table, the periodic flushing box moves directly beneath the functional droplet discharge head (carriage unit), and the target unit which is positioned between the setting table and the periodic flushing box moves directly beneath the photography unit. In this state, placement, removal, and alignment of the workpiece (the placement/removal action) are carried out, and while the placement/removal action is being carried out, the flushing discharge (maintenance action) from the droplet discharge head onto the periodic flushing box is carried out, as is the image confirmation (discharge inspection) by the photography unit.

SUMMARY

However, with this type of droplet discharge device, since the target unit is disposed between the workpiece table and the periodic flushing box, inspection discharge can be carried out in continuation with the drawing action by including the inspection data in the drawing data, but there has been a restriction in that the image recognition (discharge inspection) can be carried out only during the workpiece placement/removal action. Therefore, in cases in which the discharge inspection is longer than the time duration of the placement/removal action, it affects the takt time of processing the workpiece. Conversely, if the intention is to preserve the takt time, there is a problem with time constraints on the inspection details.

An object of the present invention is to provide, first, a droplet discharge device and a method for controlling a droplet discharge device whereby discharge inspection of a droplet discharge head can be carried out without affecting the takt time of processing the workpiece and without being subject to time constraints; and, second, a droplet discharge device and a method for controlling a droplet discharge device whereby the takt time of processing the workpiece device can be reduced and sufficient time can be taken for discharge inspection of the functional droplet discharge head.

Single Stage Configuration

A droplet discharge device according to one aspect is adapted to perform drawing of droplets of functional liquid from a functional droplet discharge head onto a workpiece in a drawing area, and to perform discharge inspection of the functional droplet discharge head in an inspection area, which is separated from the drawing area. The droplet discharge device includes a positioning stage, a flushing unit, an inspection stage, an image recognition device and a movement mechanism. The positioning stage is configured and arranged to support the workpiece placed thereon. The positioning stage is disposed on a common movement axis passing through the drawing area and the inspection area. The flushing unit is disposed on the common movement axis closer to the inspection area with respect to the positioning stage, and configured and arranged to receive droplets from the functional droplet discharge head during a flushing discharge. The inspection stage is disposed on the common movement axis closer to the inspection area with respect to the flushing unit, and configured and arranged to support thereon an inspection sheet for receiving droplets from the functional droplet discharge head during an inspection discharge. The image recognition device is disposed in the inspection area, and configured and arranged to conduct image recognition of the droplets discharged on the inspection sheet during the inspection discharge. The movement mechanism is configured and arranged to move the positioning stage, the flushing unit and the inspection stage along the common movement axis. The movement mechanism is configured and arranged to move the inspection stage independently of the positioning stage and the flushing unit.

According to this configuration, the positioning stage, the flushing unit, and the inspection stage are provided sequentially from the drawing area so as to be capable of moving over a movement axis extending between the drawing area and the inspection area, and the image recognition device is provided in the inspection area. The inspection stage is configured to be capable of moving separately from the positioning stage and the flushing unit. Therefore, after the inspection discharge is performed on the inspection stage in the drawing area, the inspection stage is made to face the image recognition device and the discharge inspection (image recognition) of the functional droplet discharge head is carried out, but the positioning stage can be made to face the drawing area and drawing can be carried out in parallel with the discharge inspection. When a workpiece is being placed or removed, the functional droplet discharge head is made to relatively face the flushing unit and flushing discharge (maintenance) is carried out, but the time needed for this placement/removal can also be used as the time for the discharge inspection of the functional droplet discharge head. Therefore, the discharge inspection of the functional droplet discharge head can be carried out without affecting the takt time of processing the workpiece and without being subject to time constraints.

In the droplet discharge device, the movement mechanism is preferably further configured and arranged to move the flushing unit independently of the positioning stage and the inspection stage.

According to this configuration, when a workpiece is being placed or removed, the functional droplet discharge head can be made to relatively face the flushing unit and flushing discharge can be carried out. Therefore, when a workpiece is being placed or removed, the functional droplet discharge head can be preserved in a satisfactory state.

The droplet discharge device preferably further includes a main chamber accommodating the drawing area and the inspection area, and a supplemental chamber accommodating a sub-maintenance area for maintaining the inspection stage. The sub-maintenance area is preferably disposed along the common movement axis so that the inspection area is disposed between the drawing area and the sub-maintenance area.

According to this configuration, the inspection stage on which the inspection sheet is mounted can move from the main chamber to the supplemental chamber, allowing replacement of the inspection sheet and other maintenance operations to be carried out. It is thereby possible to carry out maintenance of the inspection stage without affecting the drawing action in the main chamber.

The droplet discharge device preferably further includes a control unit configured to control the functional droplet discharge head, the image recognition device and the movement mechanism to perform the discharge inspection including a discharge failure inspection for inspecting a discharge failure of discharge nozzles in the functional droplet discharge head and a discharge amount inspection for inspecting an amount of the functional liquid discharged from the discharge nozzles, the control unit being configured to perform a first inspection discharge on the inspection sheet for inspecting the discharge failure and a second inspection discharge on the inspection sheet for inspecting the discharged amount, and then to perform image recognition on a discharge result of the first inspection discharge and to perform image recognition on a discharge result of the second discharge inspection.

In this aspect, discharge inspection of the functional droplet discharge head can be carried out during the drawing action. In other words, a sufficient amount of time for discharge inspection can be guaranteed. Therefore, in addition to discharge failure inspection of the functional droplet discharge head, discharge amount inspection can also be carried out, and the inspection result is reflected in the drawing action, whereby the drawing quality and the workpiece yield rate can be improved.

In the droplet discharge device, the discharge inspection of the functional droplet discharge head preferably includes a discharge failure inspection for inspecting a discharge failure of discharge nozzles in the functional droplet discharge head, and a discharge amount inspection for inspecting an amount of functional liquid discharged from the discharge nozzles. The inspection stage preferably has a first inspection stage configured and arranged to support a first inspection sheet for receiving droplets discharged during a first inspection discharge for the discharge failure inspection, and a second inspection stage configured and arranged to support a second inspection sheet for receiving droplets discharged during a second inspection discharge for the discharge amount inspection. The image recognition device preferably has a first image recognition unit configured and arranged to conduct image recognition of the droplets discharged during the first inspection discharge on the first inspection sheet, and a second image recognition unit configured and arranged to conduct image recognition of the droplets discharged during the second inspection discharge on the second inspection sheet.

According to this configuration, since the first inspection discharge for the discharge failure inspection is received by the first inspection stage (first inspection sheet) and the second inspection discharge for the discharge amount inspection is received by the second inspection stage (second inspection sheet), the discharge patterns of the discharge failure inspection and the discharge amount inspection are not mutually constrained. At the same time, the control system for discharge inspection can be simplified.

In the droplet discharge device, a frequency of replacing the second inspection sheet is preferably set higher than the frequency of replacing the first inspection sheet. The first inspection stage and the second inspection stage are preferably provided in this sequence from the positioning stage along the common movement axis. The movement mechanism is preferably configured and arranged to move the first inspection stage and the second inspection stage independently of each other.

According to this configuration, since the first inspection sheet and the second inspection sheet are replaced at different frequencies, the winding timing, the replacement timing, and other characteristics of the inspection sheets can be adjusted separately. Since the second inspection stage which has the higher replacement frequency is provided at the outermost end of the common movement axis, the first inspection stage is not an obstacle when the second inspection sheet is replaced.

According to another aspect of the present invention, a method for controlling a droplet discharge device having a drawing area in which a functional droplet discharge head is driven and drawing of droplets of functional liquid is performed on a workpiece while the workpiece is moved, and an inspection area in which discharge inspection of the functional droplet discharge head is performed, includes: selectively moving a positioning stage on which the workpiece is positioned and an inspection stage for receiving an inspection discharge from the functional droplet discharge head along a common movement axis passing through the drawing area and the inspection area; discharging droplets from the functional droplet discharge head on the inspection sheet in the drawing area during an inspection discharge immediately before drawing is performed on the workpiece; and while drawing is thereafter being performed on the workpiece in the drawing area, moving the inspection stage to the inspection area along the common movement axis and performing image recognition of the droplets discharged on the inspection sheet during the inspection discharge by an image recognition device disposed in the inspection area.

According to this configuration, since discharge inspection (image recognition) of the functional droplet discharge head is carried out during drawing on the workpiece, sufficient time can be taken for the discharge inspection. Therefore, the discharge inspection of the functional droplet discharge head can be carried out without affecting the takt time of processing the workpiece and without being subject to time constraints.

Double Stage Configuration

A droplet discharge device according to another aspect includes a drawing area, first and second placement/removal areas, first and second inspection areas, first and second positioning stages, first and second inspection stages, first and second image recognition devices, and a movement mechanism. The drawing area is an area in which a functional droplet discharge head is driven to discharge droplets of functional liquid on a workpiece while the workpiece is moved along a common movement axis. The first and second placement/removal areas are areas in which placement and removal of the workpiece are alternately carried out, the first and second placement/removal areas being separated from the drawing area and disposed respectively on both sides of the drawing area along the common movement axis. The first and second inspection areas are areas in which discharge inspections of the functional droplet discharge head using image recognition are alternately carried out. The inspection areas are separated outwardly along the movement axis from the first and second placement/removal areas, respectively. The first and second positioning stages are configured and arranged to support thereon the workpiece. The first and second inspection stages are respectively disposed outwardly of the first and second positioning stages along the common movement axis, and configured and arranged to respectively support first and second inspection sheets for receiving droplets from the functional droplet discharge head during inspection discharges. The first and second image recognition devices are respectively disposed in the first and second inspection areas, and configured and arranged to respectively conduct image recognition on the droplets discharged during the inspection discharges on the first and second inspection sheets. The movement mechanism is configured and arranged to selectively move the first positioning stage between the drawing area and the first placement/removal area and to selectively move the second positioning stage between the drawing area and the second placement/removal area, and to selectively move the first inspection stage between the drawing area and the first inspection area and to selectively move the second inspection stage between the drawing area and the second inspection area.

In this case, preferably, a control unit is further provided for controlling the functional droplet discharge head, the first and second image recognition devices, and the first and second movement mechanisms; wherein the control unit alternately moves the first and second positioning stages between the drawing area and the first and second placement/removal areas and alternately carries out the drawing action, and also alternately moves the first and second inspection stages between the drawing area and the first and second inspection areas and alternately carries out the inspection discharge and the discharge inspection which are performed together with the drawing action.

According to this configuration, the first and second positioning stages are moved between the drawing area and the first and second placement/removal areas, the drawing action is alternately carried out, the first and second inspection stages are moved between the drawing area and the first and second inspection areas, and the inspection discharge and the discharge inspection performed together with the drawing action are alternately carried out. It is thereby possible to alternately and continuously carry out the drawing action on the workpiece and the discharge inspection of the functional droplet discharge head. After an inspection discharge on one of the first and second inspection stages, if this inspection stage is moved immediately to an inspection area, discharge inspection by one of the first and second image recognition devices can be carried out while drawing is being carried out on the workpiece in one of the first and second positioning stages. Furthermore, if the intention is to take the time for the discharge inspection, the time during the drawing action on the workpiece in the other of the first and second positioning stages can be used as the discharge inspection time without interruption. Therefore, the takt time of the drawing action on the workpiece can be reduced, and sufficient time for the discharge inspection can be taken.

In the droplet discharge device, the movement mechanism is preferably configured to selectively move the first and second positioning stages and the first and second inspection stages along the common movement axis.

According to this configuration, the structure of the movement system in the first and second positioning stages and the first and second inspection stages can be simplified. A linear motor is preferably used for the movement mechanism.

In the droplet discharge device, the control unit is preferably further configured to reciprocate the first and second positioning stages a plurality of times along the movement axis to carry out the drawing in the drawing area, and move the first and second inspection stages from the first and second inspection areas, respectively, to the drawing area to carry out the inspection discharge in synchronization with an initial advancing action of the reciprocating movement.

In the droplet discharge device, the control unit is preferably configured to move the first and second inspection stages from the drawing area to the first and second inspection areas, respectively, to carry out the discharge inspection after carrying out the inspection discharge.

According to this configuration, the inspection discharge can be carried out without affecting the drawing action, and an inspection discharge reflective of the actual drawing conditions can be performed. As the inspection discharge is performed in the initial stage of the drawing action, sufficient time for the discharge inspection can be taken.

Furthermore, the control unit is preferably configured to complete the discharge inspection before completion of the drawing onto the workpiece accompanying the inspection discharge.

According to this configuration, since the inspection result of the discharge inspection can be reflected in the next drawing action, the yield rate can be improved.

Similarly, the control unit is preferably configured to complete the discharge inspection before completion of the drawing onto the workpiece that follows the drawing onto the workpiece accompanying the inspection discharge.

According to this configuration, a high-precision discharge inspection requiring time can be performed without affecting the takt time of processing the workpiece (the drawing action).

The droplet discharge device preferably further includes first and second placement/removal mechanisms respectively disposed in the first and second placement/removal areas to place and remove the workpiece on and from the first and second positioning stages. The control unit is preferably configured to control the first and second placement/removal mechanisms so that placement/removal of the workpiece is carried out on the first and second positioning stages which have moved respectively into the first and second placement/removal areas.

According to this configuration, placement and removal of the workpiece on the positioning stages can be performed continuously. In other words, the drawing action on the workpiece and placement/removal of the workpiece can be performed alternately and continuously, and the workpiece can be processed (the drawing action) efficiently.

The droplet discharge device preferably further includes a single flushing unit disposed between the first and second positioning stages, and configured and arranged to receive droplets from the functional droplet discharge head during a flushing discharge, the movement mechanism being configured and arranged to move the flushing unit between the first and second placement/removal areas.

According to this configuration, even in cases in which the discharge inspection result described above is NG, or other cases in which the drawing action is temporarily stopped, a flushing discharge from the functional droplet discharge head can be carried out, and the discharge performance of the functional droplet discharge head can be preserved. The flushing unit can also be used to carry out a flushing discharge (pre-drawing flushing) which is always performed at the start of drawing.

Similarly, the droplet discharge device preferably further includes a single flushing unit disposed outwardly of one of the first and second inspection stages along the common movement axis, and configured and arranged to receive droplets from the functional droplet discharge head during a flushing discharge, and the movement mechanism being configured and arranged to move the flushing unit between a corresponding one of the first and second inspection areas and the drawing area According to this configuration, the flushing unit has a configuration which is positioned at the outermost end of the workpiece in the movement direction. The maintenance of the flushing unit can thereby be performed irrespective of the drawing action.

Similarly, the droplet discharge device preferably further includes first and second flushing units respectively disposed inwardly of the first and second positioning stages along the movement axis, and configured and arranged to receive droplets from the functional droplet discharge head during a flushing discharge. The movement mechanism is preferably configured and arranged to move the first and second flushing units as an integrated unit with the first and second positioning stages, respectively.

According to this configuration, even in cases in which the discharge inspection result described above is negative, or other cases in which the drawing action is temporarily stopped, a flushing discharge from the functional droplet discharge head can be carried out, and the discharge performance of the functional droplet discharge head can be preserved. The flushing unit can also be used to carry out a flushing discharge (pre-drawing flushing) which is always performed at the start of drawing. Moreover, the movement system of the flushing units and the positioning stages can be simplified. The flushing units may have a design of being mounted on the positioning stages, or a design of being connected.

Preferably, the droplet discharge device further includes a single weight measurement stage disposed between the first and second positioning stages, and configured and arranged to measure a weight of the functional liquid discharged from the functional droplet discharge head. The movement mechanism is preferably configured and arranged to move the weight measurement stage between the first and second placement/removal areas.

According to this configuration, in cases in which the weight of the discharged functional liquid must be measured, such as when the functional droplet discharge head is replaced (a carriage is replaced), this measurement can be carried out on the movement mechanism, and productivity can be improved.

Furthermore, the droplet discharge device preferably further includes a single weight measurement stage disposed outwardly of one of the first and second inspection stages along the common movement axis, and configured and arranged to measure a weight of the functional liquid discharged from the functional droplet discharge head. The movement mechanism is preferably configured and arranged to move the weight measurement stage between a corresponding one of the first and second inspection areas and the drawing area.

According to this configuration, the weight measurement stage has a configuration which is positioned at the outermost end of the workpiece in the movement direction. The maintenance of the weight measurement stage can thereby be performed irrespective of the drawing action.

BRIEF DESCRIPTION OF THE DRAWINGS

Referring now to the attached drawings which form a part of this original disclosure.

DETAILED DESCRIPTION OF EXEMPLARY EMBODIMENTS

A droplet discharge device and a control method thereof according to an embodiment of the present invention will be described hereinbelow with reference to the accompanying drawings. This droplet discharge device is incorporated into a flat-panel display manufacturing line and uses an inkjet-type functional droplet discharge head into which a specialized ink or luminescent resin liquid is introduced as a functional liquid. The droplet discharge device forms color filters or luminescent elements or the like as pixels of an organic EL device, while in parallel carrying out function preservation and function restoration (maintenance) of the functional droplet discharge head.

First Embodiment

Single Stage

Figure 1:
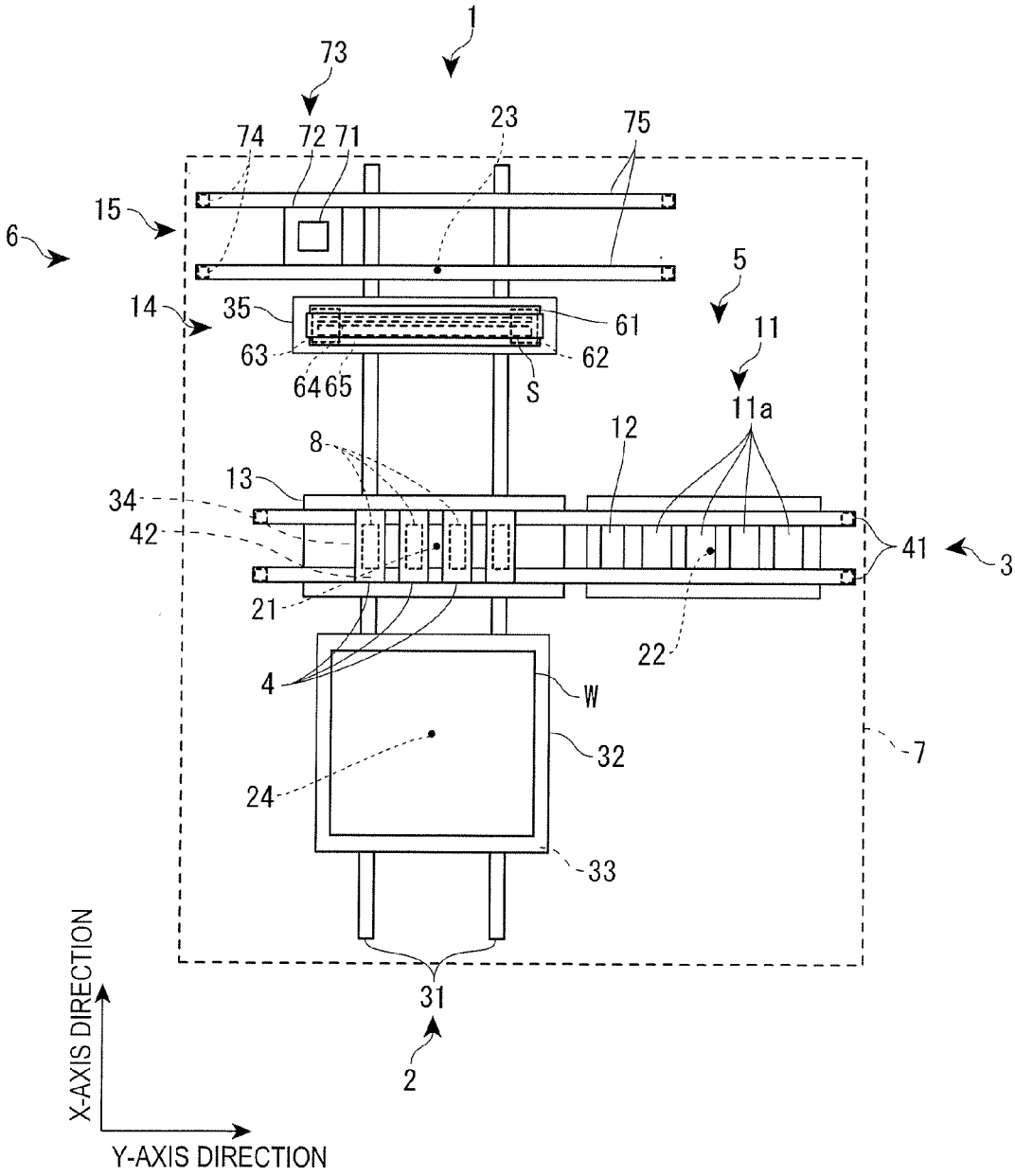
FIG. 1 is a schematic plan view of the droplet discharge device according to the first embodiment.

As shown in FIG. 1, the droplet discharge device 1 is composed of an X-axis table 2 for moving a workpiece W in the X-axis direction, the X-axis table 2 extending in the X-axis direction as the primary scanning direction during drawing; a Y-axis table 3 erected so as to span across the X-axis table 2 and made to extend in the Y-axis direction as a secondary scanning direction during drawing; and thirteen carriage units 4 in which a plurality of (twelve) functional droplet discharge heads 8 is mounted, the carriage units 4 being suspended by the Y-axis table 3 so as to be able to move. By selectively driving the discharge of the functional droplet discharge heads 8 synchronously with the driving of the X-axis table 2 and the Y-axis table 3, the droplet discharge device 1 draws on the workpiece W on the basis of a predetermined drawing pattern. Only four carriage units 4 are shown in the drawings, and only one functional droplet discharge head 8 is shown in each carriage unit 4 in the drawings.

The droplet discharge device 1 is also provided with a maintenance device 5 that has a suction unit 11, a wiping unit 12, and a flushing unit 13 and that performs maintenance on the functional droplet discharge heads 8; and a discharge inspection device 6 that has an inspection stage 14 and an image recognition unit 15 (image recognition device) and that performs discharge inspection on the functional droplet discharge heads 8. The suction unit 11 and the wiping unit 12 are provided in a maintenance area 22 described hereinafter, the flushing unit 13 and the inspection stage 14 are provided to be free to move between a drawing area 21 and an inspection area 23 described hereinafter, and the image recognition unit 15 is provided in the inspection area 23.

Furthermore, the droplet discharge device 1 comprises a control device (not shown) for collectively controlling these structural devices, and also comprises a chamber 7 for housing these structural devices. The chamber 7 has the design of a prefabricated green booth, the interior of which is constantly being ventilated, and the internal atmosphere is harmonized to a constant temperature.

The drawing area 21 for performing the drawing process on the workpiece W is set up in a region where the X-axis table 2 and the Y-axis table 3 intersect, and the maintenance area 22 where the suction unit 11 and the wiping unit 12 are disposed is set up in the movement region of the Y-axis table 3 which is separated in the Y-axis direction from the drawing area 21. The inspection area 23 where the aforementioned discharge inspection device 6 is disposed is set up in one movement region of the X-axis table 2 separated in the X-axis direction from the drawing area 21, and a placement/removal area 24 for placing and removing the workpiece W is set up in another movement region.

The X-axis table 2 has a pair of X-axis guide rails 31 (movement shafts) extending in the X-axis direction, a positioning stage 32 on which the workpiece W is positioned by adhesion through suction, the positioning stage 32 being mounted on the pair of the X-axis guide rails 31; a positioning stage movement mechanism 33 for moving the positioning stage 32 along the X-axis guide rails 31, a flushing movement mechanism 34 for moving the flushing unit 13 along the X-axis guide rails 31, and a inspection stage movement mechanism 35 for moving the inspection stage 14 along the X-axis guide rails 31.

The positioning stage movement mechanism 33, the flushing movement mechanism 34, and the inspection stage movement mechanism 35 are configured from a linear motor having three sliders corresponding to these mechanisms, and the positioning stage 32, the flushing unit 13, and the inspection stage 14 are configured to be capable of moving individually over the X-axis guide rails 31. The pair of X-axis guide rails 31 extend so as to longitudinally traverse the placement/removal area 24, the drawing area 21, and the inspection area 23. In the present embodiment, the movement mechanism mentioned in the claims is configured from the positioning stage movement mechanism 33, the flushing movement mechanism 34, and the inspection stage movement mechanism 35. The positioning stage 32 and the flushing unit 13 may be designed so as to be moved as an integrated unit by a single slider (not shown).

The Y-axis table 3 has a pair of Y-axis guide rails 41 extending in the Y-axis direction over the X-axis table 2, a plurality of bridge plates (not shown) which are mounted so as to span across the pair of X-axis guide rails 31 and which suspend the carriage units 4, and a carriage movement mechanism 42 for moving the plurality of carriage units 4 along the Y-axis guide rails 41 via the bridge plates. The carriage movement mechanism 42 is configured from a linear motor having a plurality of sliders corresponding to the plurality of carriage units 4 (plurality of bridge plates), and the carriage units 4 are configured to be capable of moving individually (the thirteen carriage units 4 can also be moved as an integrated unit). The pair of Y-axis guide rails 41 traverses the drawing area 21 and extends into the maintenance area 22, and in addition to sub-scanning the functional droplet discharge heads 8 (the carriage units 4) during drawing, the Y-axis table 3 also causes the carriage units 4 to face the maintenance area 22 during maintenance.

The carriage units 4 are each provided with a head unit (not shown) composed of two functional droplet discharge heads 8 for each of six colors R, G, B, C, M, and Y (twelve functional droplet discharge heads 8 in total), and a head plate for supporting the twelve functional droplet discharge heads 8 so that the heads are divided into two groups of six heads each. The carriage units 4 are each provided with a θ rotation mechanism for supporting the head unit so as to enable θ rotation thereof, and a suspension member (none of which are shown) for supporting the head unit on the bridge plates via the θ rotation mechanism. The number of carriage units 4 is arbitrary, as well as the number of functional droplet discharge heads 8 mounted in each of the carriage units 4.

Figure 2:
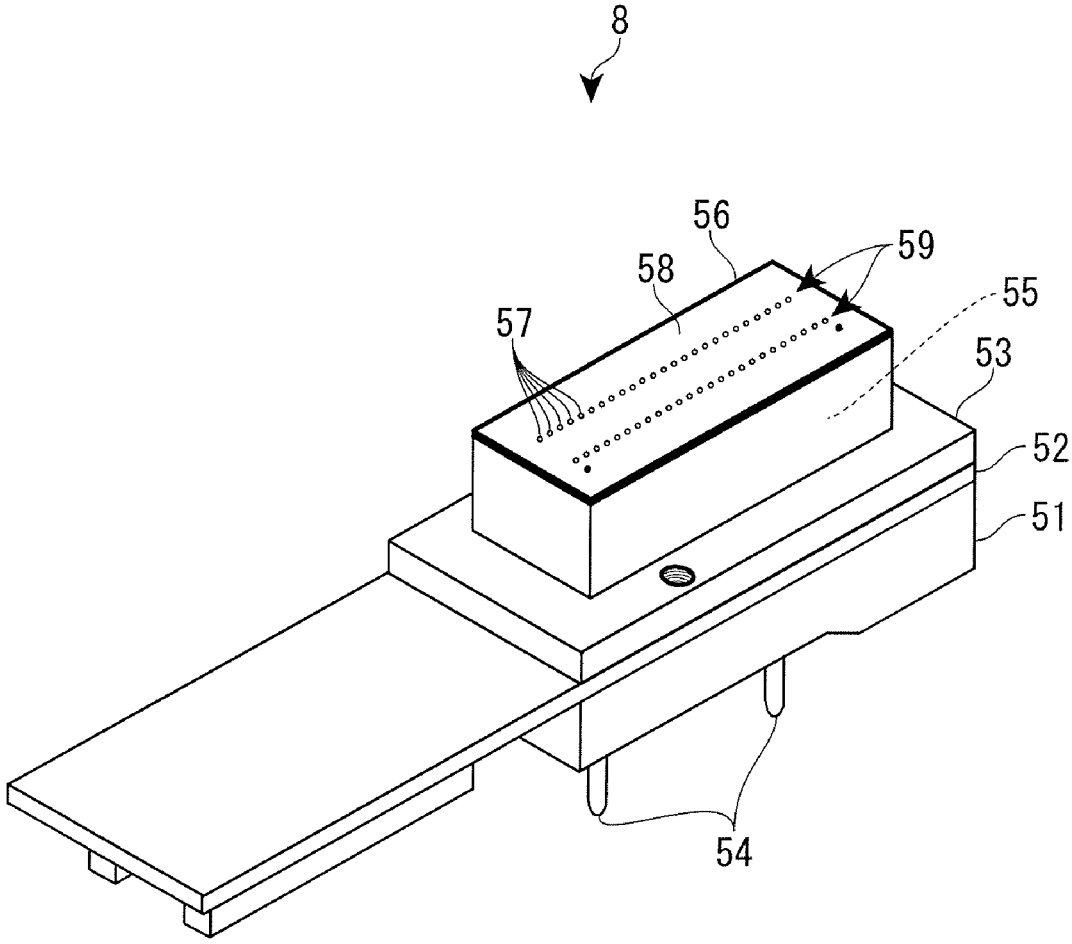
FIG. 2 is an external perspective view of the functional droplet discharge head.

As shown in FIG. 2, the functional droplet discharge head 8 is provided with a functional liquid introduction part 51 having two connecting pins 54, a double head substrate 52 that is connected to the functional liquid introduction part 51, and a head body 53 that is connected to the head substrate 52 and that discharges the functional liquid. The functional liquid introduction part 51 receives the supply of functional liquid from a functional liquid supply device outside of the drawing. The head body 53 has two pump parts 55 composed of piezoelectric elements or the like, and a nozzle plate 56 having a nozzle surface 58 in which a plurality of discharge nozzles 57 is formed. The discharge nozzles 57 formed in the nozzle plate 56 are aligned in equal intervals, and two nozzle rows 59 are formed. The two nozzle rows 59 are arrayed parallel to each other and with a positional deviation of half of a nozzle pitch. A drive waveform outputted from the control device is applied to the pump parts 55 (piezoelectric elements) via the head substrate 52, and the functional droplet discharge head 8 thereby discharges functional liquid from the discharge nozzles 57. In a first inspection discharge for inspecting for dot misplacement or trajectory deviation, described hereinafter, functional liquid is inspection-discharged from a nozzle row 59 unit, and in a second inspection discharge for measuring the discharge amount, functional liquid is discharged multiple times from a nozzle row 59 unit while the discharge position is shifted.

The suction unit 11 provided in the maintenance area 22 is configured from a plurality of carriage units 4 and the same number of individual suction units 11*a*. The individual suction units 11*a* are provided with cap units having twelve head caps corresponding to the twelve functional droplet discharge heads 8, suction mechanisms linked to the cap units, and raising/lowering mechanisms (none of which are shown) for raising and lowering the cap units. The individual suction units 11*a* raise and lower the cap units between three levels, which are a close contact position for storage and for functional liquid suction, a distanced position for flushing, and a replacement position for replacing the head units or for replacing the consumable cap units.

The wiping unit 12 is disposed between the drawing area 21 and the suction unit 11, and has a paying-out reel around which a wiping sheet is wound in a roll, a winding reel for winding the wiping sheet paid out from the paying-out reel, and pressing rollers (none of which are shown) for pressing the wiping sheet spanning between the reels against the functional droplet discharge heads 8. The wiping unit 12 feeds the wiping sheet and also moves the entire wiping sheet in the X-axis direction while pressing the wiping sheet against the functional droplet discharge heads 8 via the pressing rollers, and wipes off the nozzle surfaces 58 of the functional droplet discharge heads 8 of the carriage units 4.

The flushing unit 13 is disposed on the side of the positioning stage 32 facing the inspection area 23, and is supported by the flushing movement mechanism 34 so as to be free to slide relative to the X-axis guide rails 31. The flushing unit 13 comprises a flushing box for receiving the functional liquid discharged from the functional droplet discharge heads 8, and a suction expulsion mechanism (neither of which are shown) for suctioning out and expelling the functional liquid accumulated in the flushing box. The flushing unit 13 receives the flushing discharge (flushing) from the functional droplet discharge heads 8 and stabilizes the functional liquid discharge of the functional droplet discharge heads 8 when the workpiece W is being placed or removed.

Though not shown in the drawings, a pair of pre-drawing flushing units are disposed at the X-axis directional ends of the positioning stage 32, and are designed so as to receive the flushing from the moving functional droplet discharge heads 8 which have transitioned to the reciprocating drawing action.

The discharge inspection device 6 is disposed in the inspection area 23 (home position) set up in one region of the X-axis table 2 separated from the drawing area 21 in the X-axis direction, and is configured from the inspection stage 14 and the image recognition unit 15. During discharge inspection, the inspection stage 14 moves directly below the carriage units 4 (the functional droplet discharge heads 8) and receives the inspection discharge, after which it moves directly below the image recognition unit 15 and undergoes image recognition.

The inspection stage 14 is disposed on the side of the flushing unit 13 facing the inspection area 23, and is supported by the inspection stage movement mechanism 35 so as to be free to slide relative to the X-axis guide rails 31. The inspection stage 14 is provided with an inspection table 61 on which an inspection sheet S wound into a roll is placed and held by suction, a paying-out mechanism 62 for paying out the inspection sheet S onto the inspection table 61, and a winding mechanism 63 for winding up the inspection sheet S after inspection. The inspection stage 14 receives the inspection discharge from the functional droplet discharge heads 8 in a state in which the inspection sheet S paid out by the paying-out mechanism 62 is being held by suction to the inspection table 61. The inspection stage 14 then winds up the inspection sheet S via the winding mechanism 63 after the inspection sheet S has been filled with deposited dots and inspected, and pays out a new inspection sheet S onto the inspection table 61. The inspection sheet S paid out onto the inspection table 61 is provided with a first inspection discharge region 64 for receiving the first inspection discharge in order to carry out discharge failure inspection, and a second inspection discharge region 65 for receiving the second inspection discharge in order to carry out discharge amount inspection.

The image recognition unit 15 has a camera 71 facing the inspection stage 14 from above, a camera stand 72 for supporting the camera stand 72, a camera frame 73 which is erected so as to span across the X-axis table 2 and which supports the camera stand 72 in a manner that allows the camera stand 72 to slide in the Y-axis direction, and a camera movement mechanism (not shown) for moving the camera 71 in the Y-axis direction along the camera frame 73 via the camera stand 72. The camera frame 73 is configured from a plurality of support columns 74 provided on both sides of the X-axis table 2, and a pair of camera guides 75 supported on the support columns 74 and extending in the Y-axis direction; and the camera frame 73 overall is formed into the shape of a gate. The image recognition unit 15 continuously performs image recognition on several dots at a time among the deposited dots that have been inspection-discharged onto the inspection sheet S, while moving the camera 71 in the Y-axis direction via the camera stand 72. A plurality of cameras 71 may also be provided, and in relevant cases the image recognition time can be shortened.

The following is a description of the discharge failure inspection performed based on the results of the first inspection discharge onto the first inspection discharge region 64, and the discharge amount inspection performed based on the results of the second inspection discharge onto the second inspection discharge region 65. The discharge failure inspection is intended to inspect discharge mistakes of the discharge nozzles 57 in the functional droplet discharge heads 8, wherein functional droplets are first discharged from onto the inspection sheet S from all of the discharge nozzles 57 (first inspection discharge). The results of the first inspection discharge then undergo image recognition by the image recognition unit 15. The recognized image is subjected to image processing in the control device and is inspected for dot misplacement and trajectory deviation. When the results of this inspection are a mild failure, flushing can be performed in the flushing unit 13 to restore functionality, and when the results are a severe failure, functional liquid suction and wiping can be performed by the suction unit 11 and the wiping unit 12 to restore functionality.

The discharge amount inspection is intended to inspect the amount of functional liquid discharged from the discharge nozzles 57, wherein functional liquid is discharged multiple times onto the inspection sheet S by the same nozzle row 59 while the inspection stage movement mechanism 35 is driven (second inspection discharge). The results of the second inspection discharge then undergo image recognition by the image recognition unit 15, and the average discharge amount of the discharge nozzles 57 is calculated via image processing from the surface area of the deposited dots. The drive voltage of the functional droplet discharge heads 8 is then compensated based on the calculated functional liquid discharge amount.

Thus, since inspection discharge can be performed in a smaller region in the first inspection discharge than in the second inspection discharge, the first inspection discharge region 64 can be designed to be smaller than the second inspection discharge region 65 in the primary scanning direction (the X-axis direction). The second discharge inspection does not necessarily need to be performed with every drawing on the workpiece W, and may be performed periodically. In relevant cases, the second inspection discharge region 65 is set up only when the second discharge inspection is being performed, and the entire inspection sheet S is set up in the first inspection discharge region 64 when the second inspection discharge is not being performed (not shown).

Figure 3:
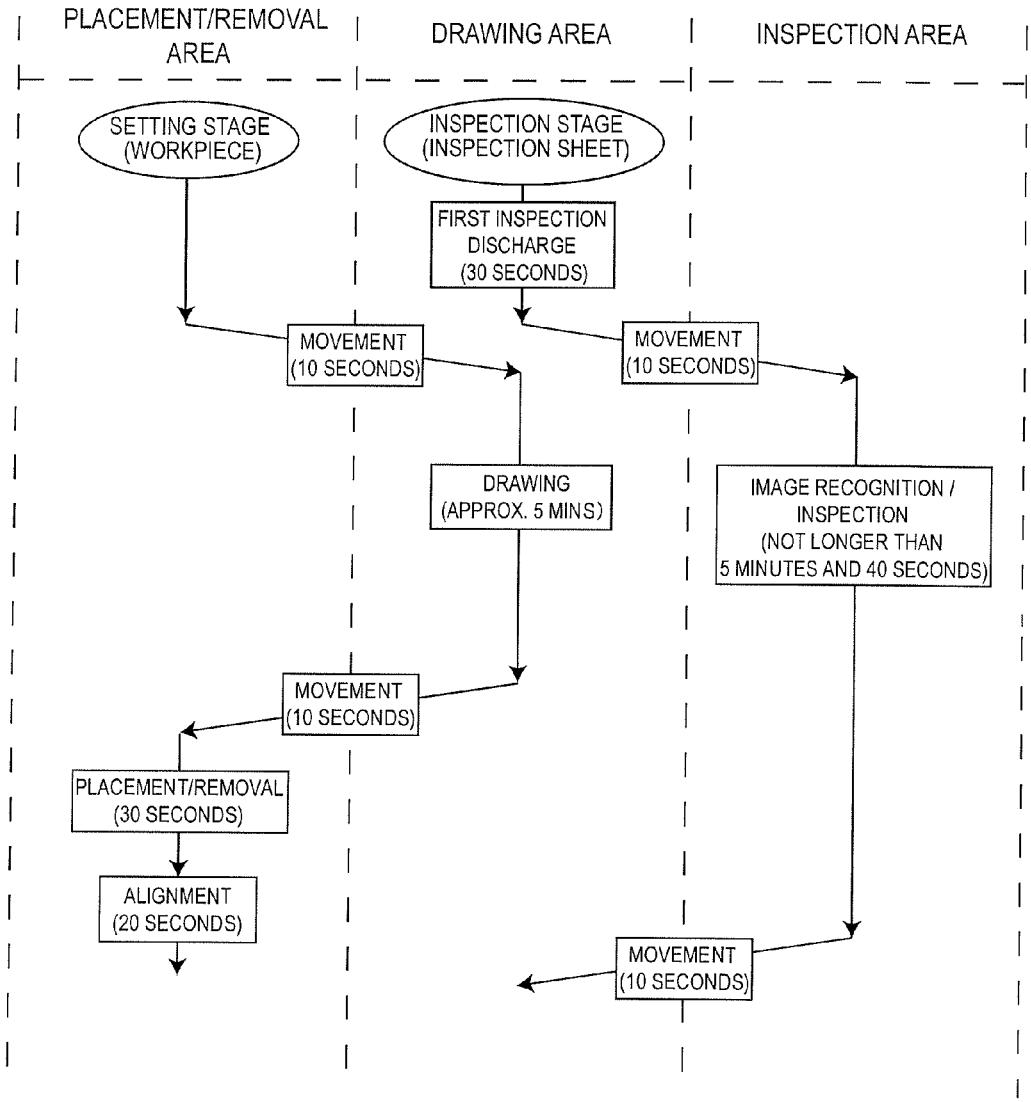
FIG. 3 is an descriptive drawing for describing the series of actions performed by the droplet discharge device according to the first embodiment.

Next, a series of actions in the droplet discharge device 1 are described with reference to FIG. 3, the description being centered around the drawing on the workpiece W and the discharge inspection of the functional droplet discharge heads 8. The description of the discharge inspection of the functional droplet discharge heads 8 herein is of a case in which only the discharge failure inspection is performed. The positioning stage 32 on which the workpiece W has been positioned in an aligned state is positioned in the placement/removal area 24, and the inspection stage 14 is positioned directly below the carriage units 4 in the drawing area 21. From this state, the inspection stage 14, the flushing unit 13, and the positioning stage 32 are moved in the X-axis direction (toward the inspection area 23), but the first inspection discharge is first carried out on the inspection sheet S. The inspection stage 14 moves toward the inspection area 23, and the positioning stage 32 moves toward the drawing area 21. The flushing unit 13 passes directly below the carriage units 4, and when the end of the positioning stage 32 arrives directly below the carriage units 4, drawing on the workpiece W is begun.

After the first inspection discharge, when the inspection stage 14 arrives directly below the image recognition unit 15, the inspection stage 14 stops moving. Next, the image recognition unit 15 is driven, the deposited dots of the first inspection discharge are subjected to image recognition, and discharge mistakes are inspected. In the drawing area 21, the workpiece W is reciprocated in the primary scanning direction (the X-axis direction), the carriage units 4 are moved as appropriate in the secondary scanning direction (the Y-axis direction), and drawing is performed on the workpiece W on the basis of a predetermined discharge pattern. In other words, while drawing is being carried out on the workpiece W in the drawing area 21, discharge failure inspection, in which the deposited dots are the focus of image recognition, is carried out in the inspection area 23.

When drawing on the workpiece W is ended, the positioning stage 32 moves to the placement/removal area 24, while at the same time, the flushing unit 13 moves directly below the carriage units 4. The old workpiece W is then replaced with a new workpiece W, and the newly placed workpiece W is aligned. In parallel with this action, flushing from the carriage units 4 is performed in the flushing unit 13, and the meniscus of the functional droplet discharge heads 8 is satisfactorily preserved. Furthermore, during this time, the inspection stage 14, which has finished undergoing discharge scanning, is moved back to the drawing area 21 and submitted for the next inspection discharge. By repeating the steps described above, discharge scanning of the functional droplet discharge heads 8 is performed both during drawing on the workpiece W and placement/removal of the workpiece W. Since discharge inspection is performed during drawing on the workpiece W, when the result of the discharge inspection is a failure, drawing on the workpiece W is halted, the functionality of the carriage units 4 (the functional droplet discharge heads 8) is restored, and the workpiece W is replaced (removed and placed).

With this type of configuration, the positioning stage 32, the flushing unit 13, and the inspection stage 14 are configured so as to be capable of moving individually in the listed order over the X-axis guide rails 31 from the drawing area 21, and the image recognition unit 15 is set in the inspection area 23. Discharge inspection of the functional droplet discharge heads 8 can thereby be carried out without any time constraints during drawing in the drawing area 21 or during placement/removal and alignment of the workpiece W in the placement/removal area 24.

First Modification

Single Stage

Figure 4:
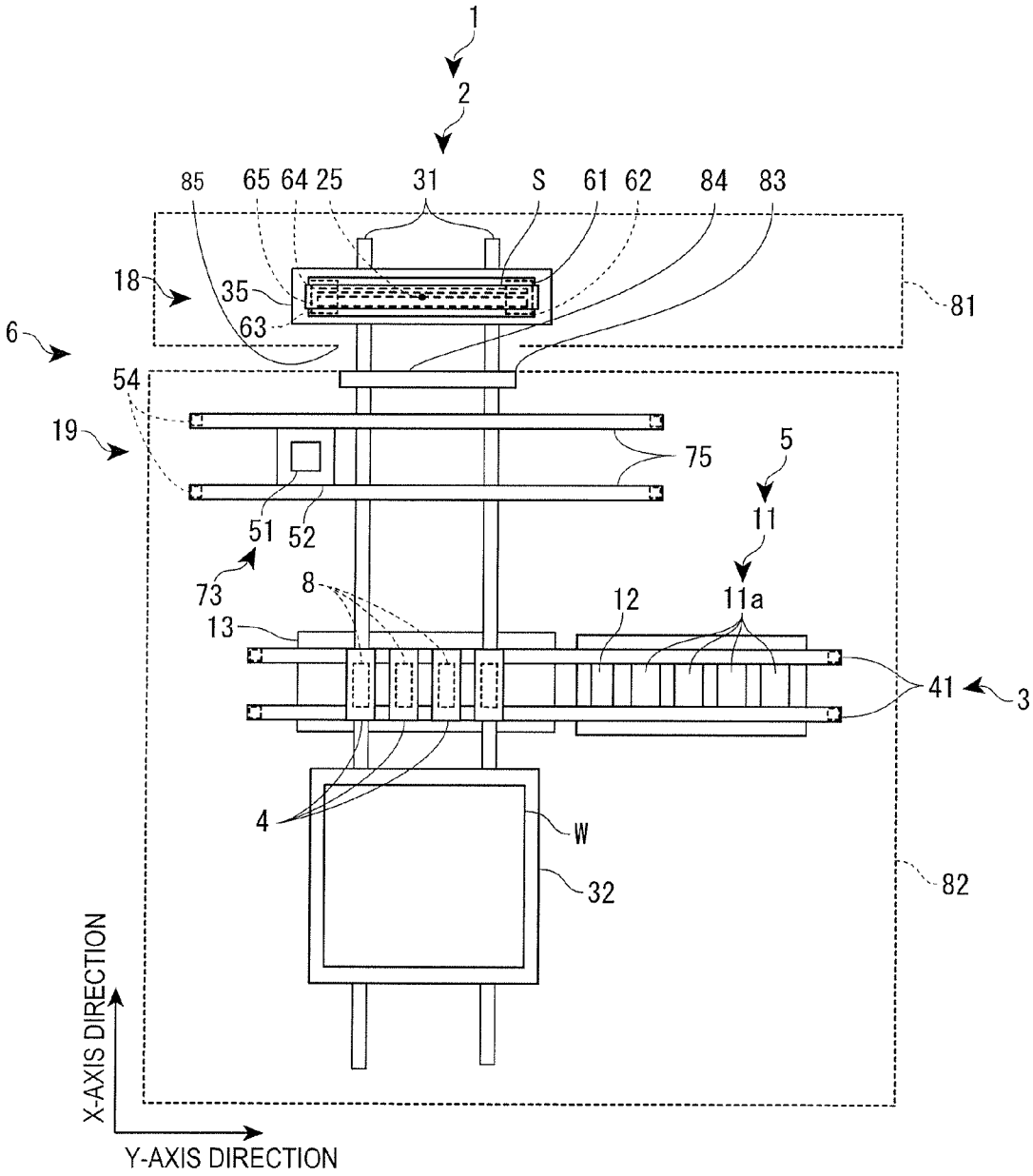
FIG. 4 is a schematic plan view of the droplet discharge device according to the first modification of the first embodiment.

Next, the droplet discharge device 1 according to a first modification of the present invention will be described with reference to FIG. 4. The description primarily focuses on components different from the first embodiment in order to avoid superfluous description. In this droplet discharge device 1, the discharge amount inspection described above is carried out in addition to the discharge failure inspection. Therefore, large amounts of the inspection sheet S are consumed in the inspection stage 14, and the inspection sheet S used as roll paper must be replaced frequently. In view of this, a sub-maintenance area 25 is set up ahead of the inspection area 23 as seen from the drawing area 21, and the inspection stage 14 is capable of moving to the sub-maintenance area 25. In the chamber 7 described above, the sub-maintenance area 25 is covered by a supplemental chamber 81, and the other portions are covered by a main chamber 82. Thereby, the inspection sheet S can be replaced in the inspection stage 14 without ceasing the drawing action. The X-axis guide rails 31 are also made to extend to the sub-maintenance area 25 along with the setting up of the sub-maintenance area 25.

The main chamber 82 is configured so as to cover the drawing area 21, the inspection area 23, and the maintenance area 22; the X-axis guide rails 31 are inserted through the side wall facing the supplemental chamber 81 in the X-axis direction; and this side wall is also provided with a main chamber opening 83 through which the inspection stage 14 passes, as well as an opening/closing lid 84 for opening and closing the portion of the main chamber opening 83 excluding the X-axis table 2. The main chamber 82 is also configured so that its internal atmosphere can be regulated by a main chamber regulation mechanism (not shown). This internal atmosphere regulation uses various sensors disposed within the main chamber 82, and controls a heater, a cooler, a fan, and other components housed within the main chamber regulation mechanism. The internal atmosphere regulation is preferably performed while the interior of the main chamber 82 is continuously being ventilated.

The supplemental chamber 81 is used primarily when the inspection sheet S of the inspection stage 14 is replaced, and is configured so as to accommodate the inspection stage 14 which has moved to the end of the X-axis table 2. The X-axis guide rails 31 are inserted through the side wall of the supplemental chamber 81 facing the main chamber 82, and a supplemental chamber opening 85 is opened to allow the inspection stage 14 to pass through. The supplemental chamber 81 is also configured so that its internal atmosphere can be regulated by a supplemental chamber regulation mechanism (not shown). This internal atmosphere regulation is the same as that of the main chamber 82.

During the actions in the droplet discharge device 1 of the present embodiment, a first inspection discharge for inspecting discharge mistakes is carried out, and a second inspection discharge for inspecting the amount of functional liquid discharged is carried out at about the same time. Specifically, the first inspection discharge is carried out, and the second inspection discharge is then carried out on the same inspection sheet S. After undergoing the first and second inspection discharges, when the inspection stage 14 arrives directly below the image recognition unit 15, the inspection stage 14 stops moving, the image recognition unit 15 is driven to conduct image recognition on the deposited dots of the first and second inspection discharges, discharge mistakes are inspected, and the discharge amount is inspected. Either the first inspection discharge or the second inspection discharge may be carried out first.

In the supplemental chamber 81 in this case, when the inspection sheet S is replaced, the opening/closing lid 84 is opened to accommodate the inspection stage 14 moving in, and after the opening/closing lid 84 is closed, the internal atmosphere is displaced by atmospheric air. After the operator has replaced the inspection sheet S in the supplemental chamber 81, the internal atmosphere of the supplemental chamber 81 is displaced by the same nitrogen or dry air in the internal atmosphere of the main chamber 82. The opening/closing lid 84 is then opened, and the inspection stage 14 is moved to the main chamber 82 and subjected to inspection discharge.

Thereby, since the inspection sheet S can be replaced in the supplemental chamber 81, there is no need to stop the droplet discharge device 1 during this replacement operation. Atmospheric disturbances, dirt, dust, and the like resulting from human activity do not affect the process in the drawing area 21 inside the main chamber 82. The main chamber regulation mechanism and the supplemental chamber regulation mechanism may also be a shared (double-purpose) chamber regulation mechanism, and flow channels may be switched in the ducts (or supply tubes) connected to this mechanism.

Second Modification

Single Stage

Figure 5:
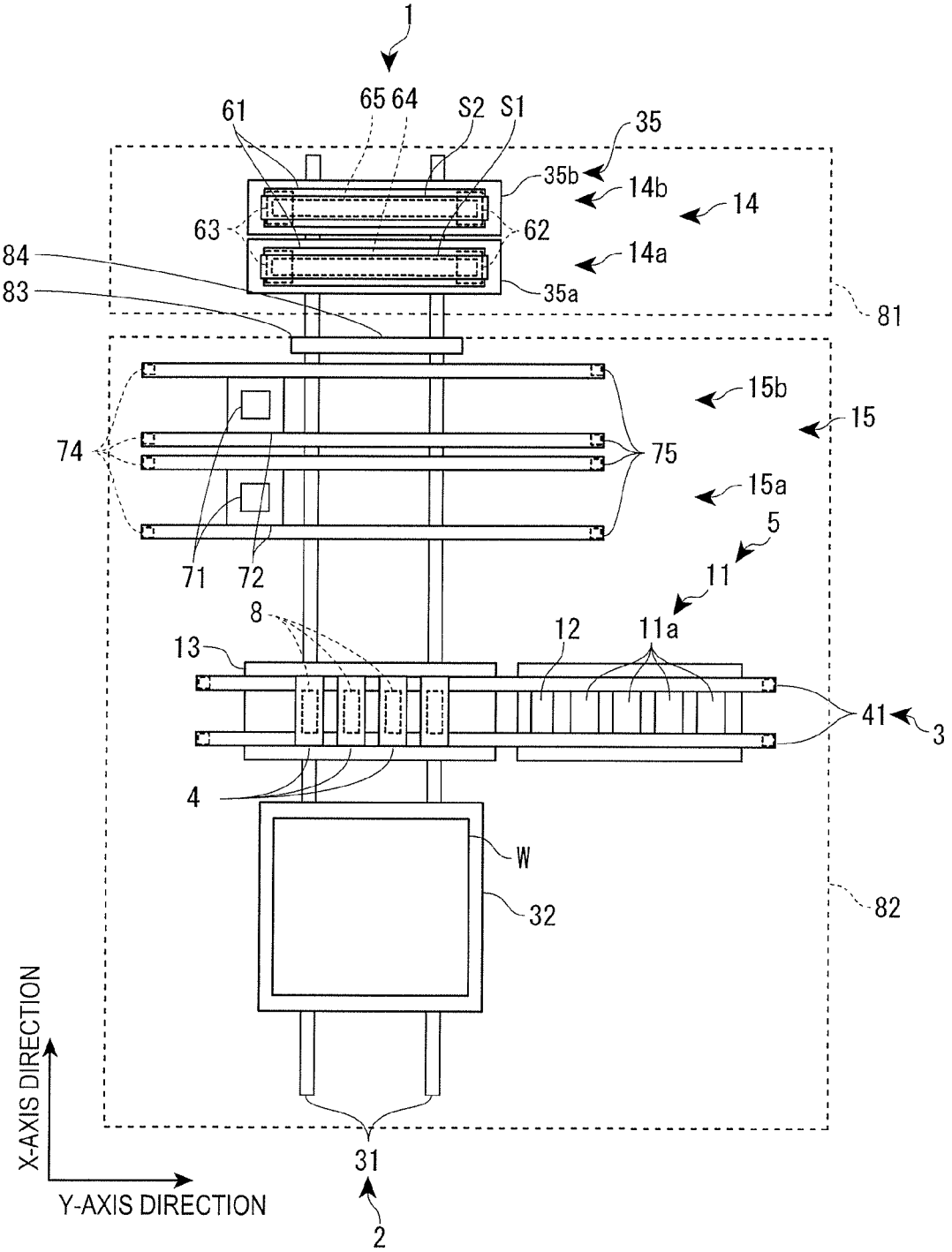
FIG. 5 is a schematic plan view of the droplet discharge device according to the second modification of the first embodiment.

Next, the droplet discharge device 1 according to a second modification of the present invention will be described with reference to FIG. 5. The inspection stage 14 in this droplet discharge device 1 is configured from a first inspection stage 14*a* where a first inspection sheet S1 and a first inspection discharge is received, and a second inspection stage 14*b* where a second inspection sheet S2 is placed and a second inspection discharge is received; and the first inspection stage 14*a* and second inspection stage 14*b* can be accommodated in the supplemental chamber 81 via the X-axis guide rails 31.

Specifically, the first inspection stage 14*a* and the second inspection stage 14*b* are configured to be capable of being moved individually along the X-axis guide rails 31 by the first inspection stage movement mechanism 35*a* and the second inspection stage movement mechanism 35*b*, respectively. Since the first inspection stage 14*a* and the second inspection stage 14*b* have the same structure as the inspection stage 14 described above, they are not described herein. Since the first inspection stage 14*a* and the second inspection stage 14*b* have the same structure as the inspection stage 14 described above, they are not described herein.

In this case, the first inspection discharge region 64 for receiving the first inspection discharge described above is provided over the entire surface of the first inspection sheet S1 of the first inspection stage 14*a*, and the second inspection discharge region 65 for receiving the second inspection discharge is provided over the entire surface of the second inspection sheet S2 of the second inspection stage 14*b*. Furthermore, as described above, the first inspection discharge (discharge failure inspection) received by the first inspection stage 14*a* can be carried out in a smaller region than the second inspection discharge (discharge amount inspection) received by the second inspection stage 14*b*, i.e., in this case, the first inspection sheet S1 and the second inspection sheet S2 are not replaced with the same frequency, but the frequency with which the second inspection sheet S2 is replaced is designed to be higher than the frequency with which the first inspection sheet S1 is replaced. Consequently, any useless features of the inspection sheets S1, S2 can be eliminated by separately managing the winding time periods and replacement time periods of the first inspection sheet S1 and the second inspection sheet S2.

The image recognition unit 15 is configured from a first image recognition unit 15*a* for conducting image recognition on the results of the first inspection discharge, and a second image recognition unit 15*b* for conducting image recognition on the results of the second inspection discharge. The first image recognition unit 15*a* and the second image recognition unit 15*b* have the same structure as the image recognition unit 15 described above and are therefore not described herein. The first image recognition unit 15*a* corresponds to the first inspection stage 14*a* and is provided at the end of the inspection area 23 so as to span across the X-axis table 2. Similarly, the second image recognition unit 15*b* corresponds to the second inspection stage 14*b* and is provided nearer to the supplemental chamber 81 than the first image recognition unit 15*a* so as to span across the X-axis table 2. The first image recognition unit 15*a* and the second image recognition unit 15*b* are placed sequentially adjacent to the drawing area 21 in the end of the X-axis table 2.

Figure 6:
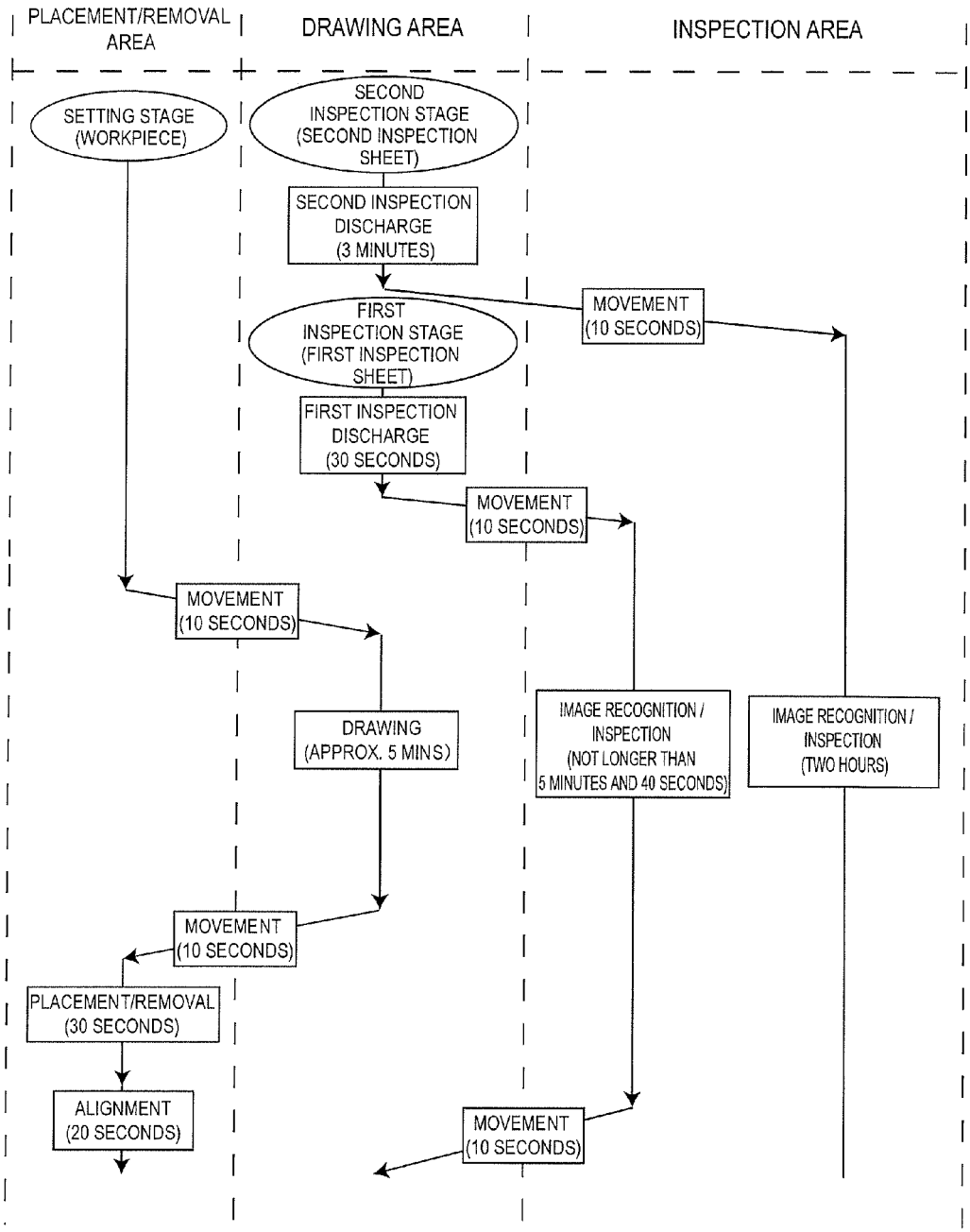
FIG. 6 is an descriptive drawing for describing the series of actions performed by the droplet discharge device according to the second modification of the first embodiment.

In the series of actions by the droplet discharge device 1 according to the present embodiment, the discharge failure inspection and discharge amount inspection are carried out independently as shown in FIG. 6. Specifically, the positioning stage 32 on which the workpiece W has been set is positioned in the placement/removal area 24, the second inspection stage 14*b* is positioned directly below the carriage units 4, and the first inspection stage 14*a* is positioned between the positioning stage 32 and the second inspection stage 14*b*. From this state, the structural devices 32, 14*a*, and 14*b* are moved in the X-axis direction (toward the inspection area 23), but first the second inspection discharge is carried out on the second inspection sheet S2. The second inspection stage 14*b* moves toward the inspection area 23 after the second inspection discharge, and the first inspection stage 14*a* moves toward the drawing area 21 and receives the first inspection discharge. The flushing unit 13 passes directly below the carriage units 4, and when the end of the positioning stage 32 arrives directly below the carriage units 4, drawing on the workpiece W is begun.

After the second inspection discharge, when the second inspection stage 14*b* arrives directly below the second image recognition unit 15*b*, the second inspection stage 14*b* stops moving. Next, the second image recognition unit 15*b* is driven, the deposited dots of the second inspection discharge are subjected to image recognition, and the discharge amount is inspected. In parallel with this action, after undergoing the first inspection discharge, when the first inspection stage 14*a* arrives directly below the first image recognition unit 15*a*, the first inspection stage 14*a* stops moving, the first image recognition unit 15*a* is driven to conduct image recognition on the deposited dots of the first inspection discharge, and discharge mistakes are inspected. In the drawing area 21, the workpiece W and the carriage units 4 undergo primary scanning and secondary scanning relative to each other, and drawing is performed on the workpiece W on the basis of a predetermined discharge pattern. After drawing on the workpiece W has ended, the positioning stage 32 is moved to the placement/removal area 24, the workpiece W is removed and a new workpiece W is placed, and the workpiece W is aligned. In parallel with this action, flushing from the carriage units 4 is carried out in the flushing unit 13. A standby mode is then implemented in which the first inspection stage 14*a* having finished discharge inspection is moved back into proximity of the drawing area 21.

In the supplemental chamber 81 in this case, when the first inspection sheet S1 (the second inspection sheet S2) is replaced, the opening/closing lid 84 is opened to accommodate either the second inspection stage 14*b* or the first inspection stage 14*a* and the second inspection stage 14*b* moving in, and after the opening/closing lid 84 is closed, the internal atmosphere is displaced by atmospheric air. After the operator has replaced the first inspection sheet S1 (the second inspection sheet S2) in the supplemental chamber 81, the internal atmosphere of the supplemental chamber 81 is displaced by the same nitrogen or dry air in the internal atmosphere of the main chamber 82. The opening/closing lid 84 is then opened, and the first inspection stage 14*a* and the second inspection stage 14*b* are moved to the main chamber 82 and subjected to inspection discharge.

Thereby, since the respective first and second inspection sheets S1 and S2 of the first inspection stage 14*a* and the second inspection stage 14*b* can be replaced in the supplemental chamber 81, there is no need to stop the droplet discharge device 1 when the first and second inspection sheets S1 and S2 are being replaced. Atmospheric disturbances, dirt, dust, and the like resulting from human activity do not affect the process in the drawing area 21 inside the main chamber 82.

Second Embodiment

Double Stage

Figure 7:
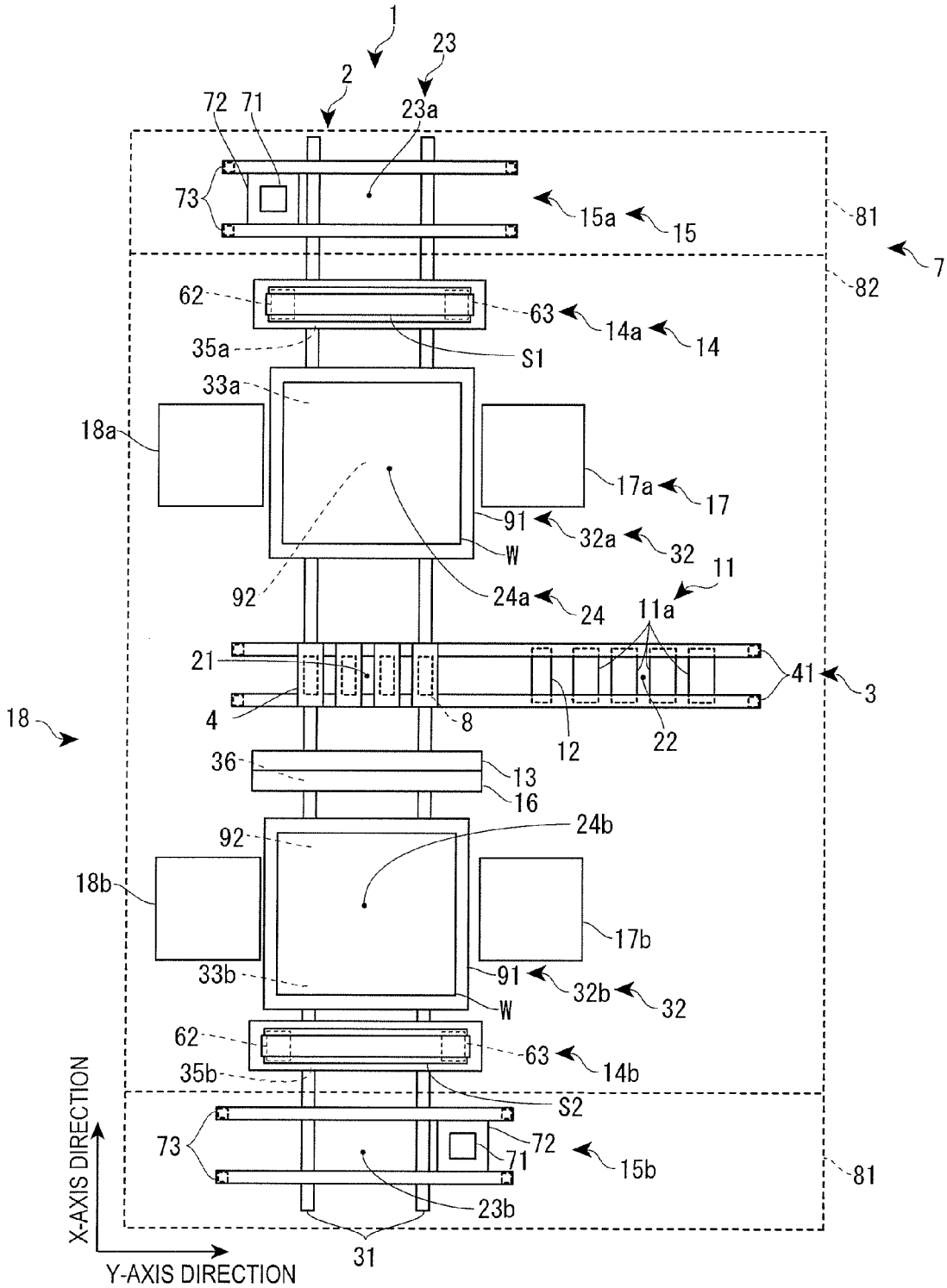
FIG. 7 is a schematic plan view of the droplet discharge device according to the second embodiment.

Next, the droplet discharge device 1 according to the second embodiment of the present invention will be described with reference to FIGS. 7 through 10. The description primarily focuses on components different from the first embodiment in order to avoid superfluous description. As shown in FIG. 7, the droplet discharge device 1 includes a pair of positioning stages 32 (first and second positioning stages), an X-axis table 2 for primarily moving a workpiece W alternately in the X-axis direction via the pair of positioning stages 32, the X-axis table 2 extending in the X-axis direction; a Y-axis table 3 erected so as to span across the X-axis table 2 and made to extend in the Y-axis direction; and thirteen carriage units 4 in which a plurality of (twelve) functional droplet discharge heads 8 is mounted, the carriage units 4 being suspended by the Y-axis table 3 so as to be able to move. In the present embodiment, the movement mechanism mentioned in the claims is configured from the X-axis table 2.

The droplet discharge device 1 comprises a suction unit 11 and a wiping unit 12 disposed in the maintenance area 22; a flushing unit 13, a weighing stage 16, and a pair of inspection stages 14 (first and second inspection stages) mounted on the X-axis table 2; a pair of image recognition units 15 (first and second image recognition units/devices) disposed in inspection areas 23*a*, 23*b*; a pair of placing/removing robots 17 (first and second placing/removing mechanisms) and a pair of alignment units 18 disposed so as to face the placement/removal area 24 described hereinafter; a control device for collectively controlling these structural devices; and a chamber 7 for housing these structural devices. The Y-axis table 3, the carriage units 4, the functional droplet discharge heads 8, the suction unit 11, the wiping unit 12, the flushing unit 13, the inspection stage 14, and the image recognition unit 15 have the same structures as in the first embodiment and are therefore not described herein.

The drawing area 21 for performing the drawing process on the workpiece W is set up in a region where the X-axis table 2 and the Y-axis table 3 intersect, and the maintenance area 22 for performing maintenance on the functional droplet discharge heads 8 is set up in a position separated outwardly toward one side along the Y-axis direction from the drawing area 21. Two placement/removal areas 24 for placing and removing the workpiece W are set up on both sides separated from the drawing area 21 in the Y-axis direction. Furthermore, two inspection areas 23 for performing discharge inspection on the functional droplet discharge heads 8 are set up on both sides separated from the placement/removal areas 24 in the Y-axis direction.

The two placement/removal areas 24 are configured from one (above in FIG. 7) first placement/removal area 24*a* and another (below in FIG. 7) second placement/removal area 24*b*. The two inspection areas 23 are configured from one (above in FIG. 7) first inspection area 23*a* and another (below in FIG. 7) second inspection area 23*b*.

The pair of positioning stages 32 are configured from a first positioning stage 32*a* and a second positioning stage 32*b*, and are mounted on the X-axis table 2. The positioning stages 32*a* (32*b*) have a suction stage 91 on which the workpiece W is set and held by suction, and a rotation mechanism 92 for supporting the suction stage 91 such that the suction stage 91 is free to rotate in the θ direction. Similarly, the pair of inspection stages 14 are configured from a first inspection stage 14*a* and a second inspection stage 14*b*. The pair of image recognition units 15 are also configured from a first image recognition unit 15*a* and a second image recognition unit 15*b*. Furthermore, the pair of placing/removing robots 17 are configured from a first placing/removing robot 17*a* and a second placing/removing robot 17*b*, and the pair of alignment units 18 are configured from a first alignment unit 18*a* and a second alignment unit 18*b*.

The X-axis table 2 has a pair of X-axis guide rails 31, a first positioning stage movement mechanism 33*a* for moving the first positioning stage 32*a* along the X-axis guide rails 31, a second positioning stage movement mechanism 33*b* for moving the second positioning stage 32*b* along the X-axis guide rails 31, a common stage movement mechanism 36 for moving the flushing unit 13 and the weighing stage 16 as an integrated unit along the X-axis guide rails 31, a first inspection stage movement mechanism 35*a* for moving the first inspection stage 14*a* along the X-axis guide rails 31, and a second inspection stage movement mechanism 35*b* for moving the second inspection stage 14*b* along the X-axis guide rails 31.

The X-axis table 2 allows the first positioning stage 32*a* to move freely between the drawing area 21 and the placement/removal area 24, and also allows the second positioning stage 32*b* to move freely between the drawing area 21 and the second placement/removal area 24*b*. The X-axis table 2 also allows the first inspection stage 14*a* to move freely between the drawing area 21 and the first inspection area 23*a*, and allows the second inspection stage 14*b* to move freely between the drawing area 21 and the second inspection area 23*b*.

The first and second positioning stage movement mechanisms 33*a*, 33*b*, the common stage movement mechanism 36, and the first and second inspection stage movement mechanisms 35*a*, 35*b* are configured as sliders driven by motors (linear motors) corresponding to these mechanisms; and the first and second positioning stage movement mechanisms 33*a*, 33*b*, the common stage movement mechanism 36, and the first and second inspection stage movement mechanisms 35*a*, 35*b* are configured to be capable of moving individually over the X-axis guide rails 31. The pair of X-axis guide rails 31 and the sliders of the linear motors (not shown) extend through the first inspection area 23*a*, the first placement/removal area 24*a*, the drawing area 21, the second placement/removal area 24*b*, and the second inspection area 23*b*. Specifically, the X-axis table 2 is designed so as to allow the first and second positioning stages 32*a*, 32*a*, the flushing unit 13, the weighing stage 16, and the first and second inspection stages 14*a*, 14*b* to move individually over a common movement axis.

The flushing unit 13 is provided between the first positioning stage 32*a* and the second positioning stage 32*b*, and is configured to be capable of being moved between the first placement/removal area 24*a* and the second placement/removal area 24*b* by the X-axis table 2. The weighing stage 16 is disposed between the first positioning stage 32*a* and the second positioning stage 32*b*, and is configured to be capable of being moved between the first placement/removal area 24*a* and the second placement/removal area 24*b* by the X-axis table 2. The inspection stages 14*a*, 14*b* are disposed outward in the X-axis direction from the positioning stages 32*a*, 32*b*, and these inspection stages receive inspection discharge from the functional droplet discharge heads 8. The weighing stage 16 has a plurality of electronic scales and a plurality of trays (neither of which are shown in the drawings) for bearing the electronic scales, and the weighing stage 16 measures the weight of the functional liquid discharged from the functional droplet discharge heads 8. The electronic scales measure the weight of the trays before and after functional liquid is discharged by the functional droplet discharge heads 8, and the scales are capable of measuring the weight of the discharged functional liquid from the difference in the weight of the trays before and after the discharge. The drive voltage of the functional droplet discharge heads 8 is then compensated based on the calculated functional liquid average discharge amount. The flushing unit 13 and the weighing stage 16 may be integrated as a unit.

The chamber 7 described above may be partitioned into a main chamber 82 for covering the drawing area 21 and the first and second placement/removal areas 24*a*, 24*b*, and a pair of supplemental chambers 81 for respectively covering the first and second inspection areas 23*a*, 23*b*; and maintenance on the flushing unit 13 and the weighing stage 16 (ink suction, tray replacement, and the like) may be performed in the supplemental chambers 81. This makes it possible to carry out maintenance of the flushing unit 13 and the weighing stage 16 without affecting drawing.

The placing/removing robots 17*a*, 17*b* face the placement/removal areas 24*a*, 24*b* from the outer sides of the X-axis table 2. In regards to the positioning stages 32*a*, 32*b* that have moved into the placement/removal areas 24*a*, 24*b*, the robots remove a drawn workpiece W from the positioning stage 32 and place a new workpiece W on the positioning stages 32*a*, 32*b*. The placing/removing action in this case includes the replacing (conveying in and out) of workpieces W and the alignment of workpieces W. The placing/removing action is designed so as to be carried out while the drawing action is being performed on the other positioning stages 32*a*, 32*b*.

Figure 8:
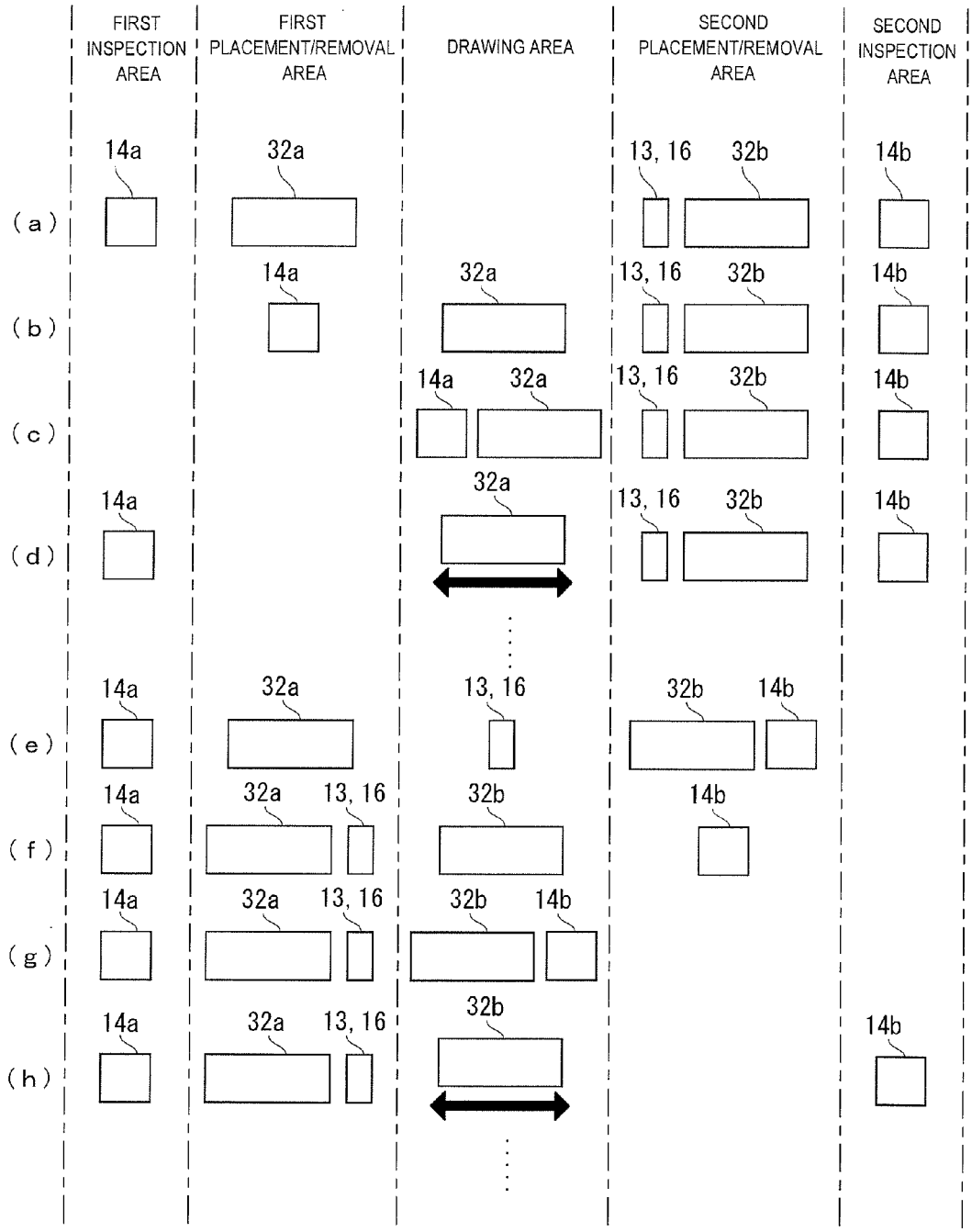
FIG. 8 is a descriptive drawing for describing the series of actions of the droplet discharge device according to the second embodiment.

Next, the series of actions in the droplet discharge device 1 will be described with reference to FIG. 8, which schematically depicts the positional relationship between the first positioning stage 32*a*, the second positioning stage 32*b*, the first inspection stage 14*a*, the second inspection stage 14*b*, the flushing unit 13, and the weighing stage 16. First, the first positioning stage 32*a* on which the workpiece W has been set in an aligned state is positioned in the first placement/removal area 24*a*, and the first inspection stage 14*a* is positioned in the first inspection area 23*a* (FIG. 8(*a*)). From this state, the first positioning stage 32*a* and the first inspection stage 14*a* are moved toward the drawing area 21, but when the forward end of the first positioning stage 32*a* first arrives directly below the carriage units 4 (in the drawing area 21), the first pass (advancing) of the drawing action over the workpiece W is begun (FIG. 8(*b*)). Then, when the first inspection stage 14*a* arrives directly below the carriage units 4, the first inspection discharge is carried out (FIG. 8(*c*)).

When the inspection discharge ends, the first inspection stage 14*a* is moved directly below the first image recognition unit 15*a* in synchronization with the retracting of the first positioning stage 32*a* and subjected to discharge inspection by the first image recognition unit 15*a* (FIG. 8(*d*)). In the drawing area 21, while the workpiece W is reciprocated multiple times in the main scanning direction (the X-axis direction), the drawing action is performed from the functional droplet discharge heads 8 onto the workpiece W on the basis of a predetermined discharge pattern (FIG. 8(*d*)). In other words, the first inspection discharge is carried out during the first pass of advancing (or retracting) in the drawing action, and during the second pass of retracting, the first inspection stage 14*a* moves to the first inspection area 23*a* and the discharge inspection is begun. The drawing action continues at the point in time when the discharge inspection is begun, and the discharge inspection is ended before the drawing action is complete (substantially before the first positioning stage 32*a* returns to the first placement/removal area 24*a*). During this time, workpieces W are removed and placed (replaced) on the second positioning stage 32*b* and the new workpiece W is aligned in the second placement/removal area 24*b* by the second placing/removing robot 17*b* and the second alignment unit 18*b*.

The first positioning stage 32*a* moves to the first placement/removal area 24*a* when the reciprocating action is finally ended. The weighing stage 16, the flushing unit 13, the second positioning stage 32*b*, and the second inspection stage 14*b* move toward the first placement/removal area 24*a* so as to follow the first positioning stage 32*a*, in synchronization with the movement of the first positioning stage 32*a* toward the first placement/removal area 24*a* (FIG. 8(*e*)). The weighing stage 16 moves directly below the carriage units 4 as necessary and receives the weight measurement discharge from the functional droplet discharge heads 8, while at the same time, the flushing unit 13 receives flushing as necessary (FIG. 8(*e*)).

When the first positioning stage 32*a*, the flushing unit 13, and the weighing stage 16 have moved to the first placement/removal area 24*a*, this time the second positioning stage 32*b* and the second inspection stage 14*b* are moved toward the drawing area 21. First, the first pass (advancing) of the drawing action is carried out over the workpiece W on the second positioning stage 32*b* (FIG. 8(*f*)), and then the inspection discharge is carried out on the second inspection stage 14*b* (FIG. 8(*g*)).

When the inspection discharge ends, the second inspection stage 14*b* is moved directly below the second image recognition unit 15*b* in synchronization with the retracting of the second positioning stage 32*b* and subjected to discharge inspection (FIG. 8(*h*)). In the drawing area 21, while the workpiece W is reciprocated multiple times in the main scanning direction, the drawing action is performed from the functional droplet discharge heads 8 onto the workpiece W on the basis of a predetermined discharge pattern (FIG. 8(*h*)). In other words, the first inspection discharge is carried out during the first pass of advancing in the drawing action, and during the second pass of retracting, the first inspection stage 14*a* moves to the first inspection area 23*a* and the discharge inspection is begun. The drawing action continues at the point in time when the discharge inspection is begun, and the discharge inspection is ended before the drawing action is complete. During this time, workpieces W are removed and placed (replaced) on the second positioning stage 32*b* and the new workpiece W is aligned in the second placement/removal area 24*b* by the second placing/removing robot 17*b* and the second alignment unit 18*b*.

By repeating the steps described above, the inspection discharges and the discharge inspections accompanying the drawing action on the workpiece W are performed alternately. Since discharge inspection is performed during drawing on the workpiece W, when the result of the discharge inspection is a failure, drawing on the workpiece W is halted, the functionality of the carriage units 4 (the functional droplet discharge heads 8) is restored, and the workpiece W is replaced (removed and placed).

In the present embodiment, inspection discharge and discharge inspection are performed every time a workpiece W undergoes a drawing action, but they may also be performed at intervals of multiple drawing actions. Specifically, for example, in cases in which discharge inspection is carried out with every two drawing actions, the drawing action on the workpieces W set on the first positioning stage 32*a* and the second positioning stage 32*b* are completed while the discharge inspection is being carried out by the first image recognition unit 15*a*. In this case, an inspection time can also be guaranteed, and a more accurate discharge inspection can be carried out (not shown).

According to the configuration described above, drawing actions are alternately carried out on the pair of positioning stages 32, and the inspection discharge and discharge inspection which accompany the drawing action are alternately carried out using the pair of inspection stages 14, whereby the drawing action on the workpiece W and the discharge inspection of the functional droplet discharge heads 8 can be alternately and continuously carried out. Since the discharge inspection by one image recognition unit 15*a* (15*b*) can be carried out while drawing on the workpiece W in one positioning stage 32*b* (32*a*) is being carried out, the takt time of the drawing action on the workpiece W can be reduced, and sufficient time can be taken for the discharge inspection.

First Modification

Double Stage

Figure 9:
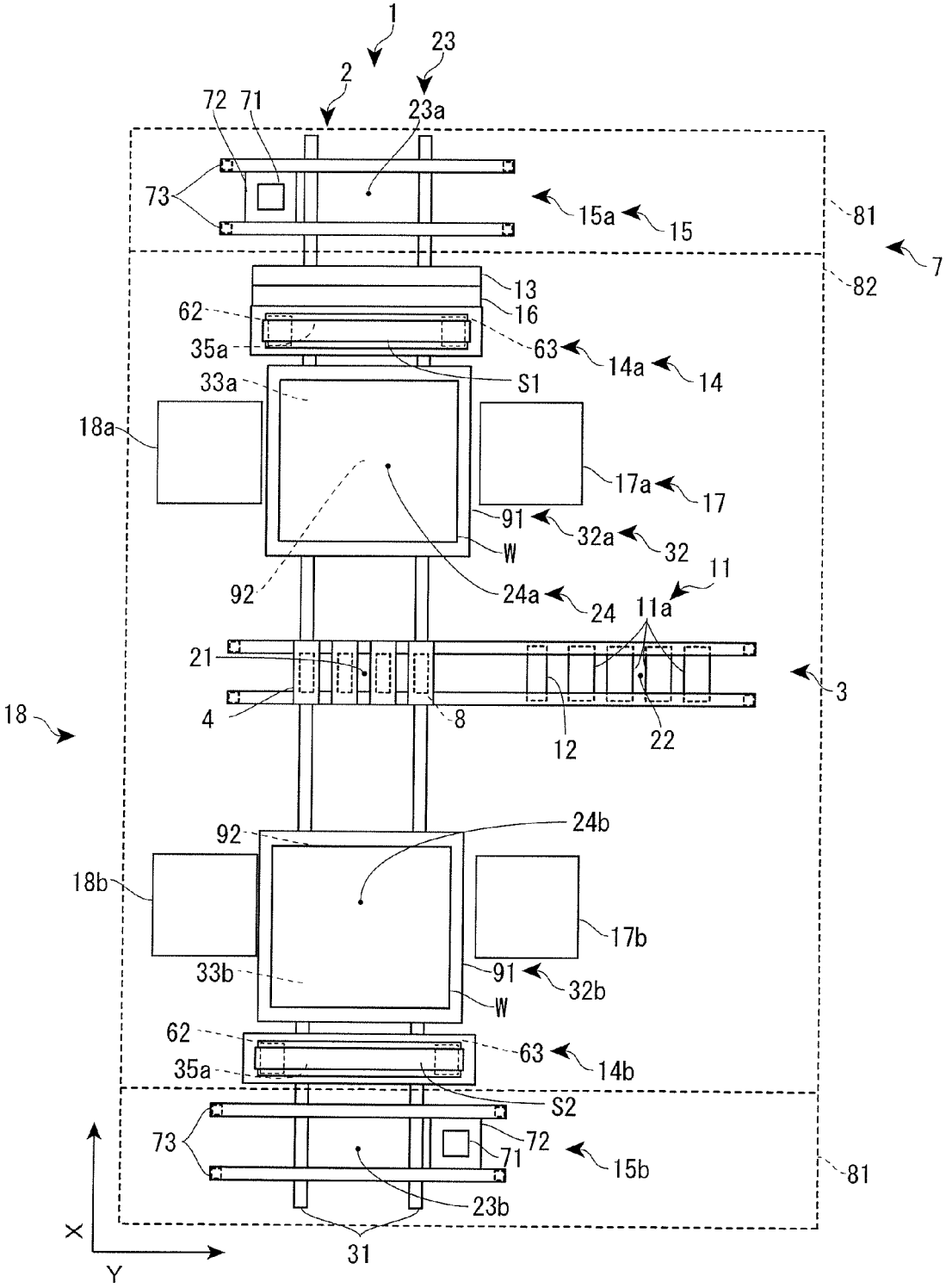
FIG. 9 is a schematic plan view of the droplet discharge device according to the first modification of the second embodiment.

Next, the droplet discharge device 1 according to a first modification of the present invention will be described with reference to FIG. 9. The description primarily focuses on different components in order to avoid superfluous description. In this droplet discharge device 1, the flushing unit 13 and the weighing stage 16 are provided on outer sides of the first inspection stage 14*a* or the second inspection stage 14*b* relative to the movement direction, and either the first inspection stage movement mechanism 35*a* or the second inspection stage movement mechanism 35*b* (the X-axis table 2) moves between either the drawing area 21 and the first inspection area 23*a* or the drawing area 21 and the second inspection area 23*b*, with either the first inspection stage 14*a* or the second inspection stage 14*b* constituting an integrated unit with the flushing unit 13 and the weighing stage 16. In this case, the drawing action, the inspection discharge, and the discharge inspection are the same as in the second embodiment described above and are therefore not described herein.

Thereby, since the flushing unit 13 and the weighing stage 16 are provided to an outer side of the first (second) inspection stage 14*a* (14*b*), the inspection sheet S can be replaced (maintenance) in the first (second) inspection area 23*a* (23*b*) and the waste functional liquid accumulated in the flushing unit 13 can be disposed (maintenance) irrespective of the drawing action.

Second Modification

Double Stage

Figure 10:
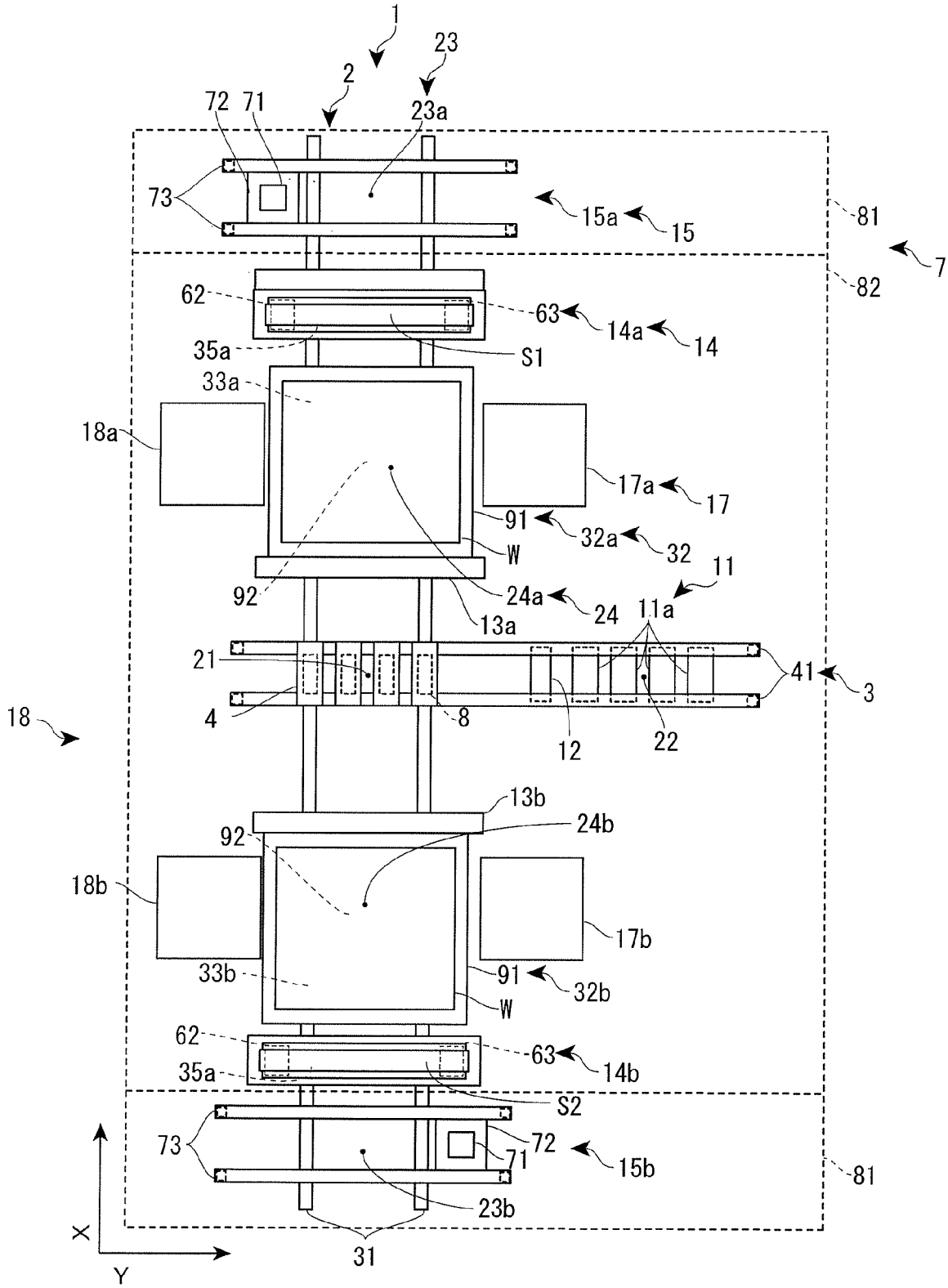
FIG. 10 is a schematic plan view of the droplet discharge device according to the second modification of the second embodiment.

Next, the droplet discharge device 1 according to a second modification of the present invention will be described with reference to FIG. 10. In this droplet discharge device 1, the weighing stage 16 is provided on an outer side of the first inspection stage 14*a* or the second inspection stage 14*b* relative to the movement direction, and a pair of flushing units 13 (first and second flushing units) are mounted (or connected) on inner sides of the positioning stages 32*a* (32*b*) relative to the movement direction. In this case, the first positioning stage movement mechanism 33*a* is configured to be capable of moving with the first positioning stage 32*a* and the first flushing unit 13*a* as an integrated unit, and the second positioning stage movement mechanism 33*b* is configured to be capable of moving with the second positioning stage 32*b* and the second flushing unit 13*b* as an integrated unit. In this case, the drawing action, the inspection discharge, and the discharge inspection are the same as in the second embodiment described above and are therefore not described herein.

Thereby, since the weighing stage 16 is positioned at the farthest outer end of the workpiece W in the movement direction, maintenance of the weighing stage 16 can be performed without stopping the drawing action. Even in cases in which the drawing action is temporarily stopped, flushing can be carried out and the discharge performance of the functional droplet discharge heads 8 can be preserved. Furthermore, since the flushing units 13*a*, 13*b* and the positioning stages 32*a*, 32*b* are configured to be capable of moving as an integrated unit, the movement system of the flushing units 13*a*, 13*b* and the positioning stages 32*a*, 32*b* can be simplified.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A droplet discharge device adapted to perform drawing of droplets of functional liquid from a functional droplet discharge head onto a workpiece in a drawing area, and to perform discharge inspection of the functional droplet discharge head in an inspection area, which is separated from the drawing area, the droplet discharge device comprising:

a positioning stage configured and arranged to support the workpiece placed thereon, the positioning stage being disposed on a common movement axis passing through the drawing area and the inspection area;

a flushing unit disposed on the common movement axis closer to the inspection area with respect to the positioning stage, and configured and arranged to receive droplets from the functional droplet discharge head during a flushing discharge;

an inspection stage disposed on the common movement axis closer to the inspection area with respect to the flushing unit, and configured and arranged to support thereon an inspection sheet for receiving droplets from the functional droplet discharge head during an inspection discharge;

an image recognition device disposed in the inspection area, and configured and arranged to conduct image recognition of the droplets discharged on the inspection sheet during the inspection discharge; and a movement mechanism configured and arranged to move the positioning stage, the flushing unit and the inspection stage along the common movement axis so that the drawing of the droplets onto the workpiece is being performed in the drawing area while the image recognition of the droplets discharged on the inspection sheet is being conducted by the image recognition device in the inspection area, the movement mechanism being configured and arranged to move the inspection stage independently of the positioning stage and the flushing unit.

2. The droplet discharge device according to claim 1, wherein the movement mechanism is further configured and arranged to move the flushing unit independently of the positioning stage and the inspection stage.

3. The droplet discharge device according to claim 1, further comprising a main chamber accommodating the drawing area and the inspection area, and a supplemental chamber accommodating a sub-maintenance area for maintaining the inspection stage, the sub-maintenance area being disposed along the common movement axis so that the inspection area is disposed between the drawing area and the sub-maintenance area.

4. The droplet discharge device according to claim 1, further comprising a control unit configured to control the functional droplet discharge head, the image recognition device and the movement mechanism to perform the discharge inspection including a discharge failure inspection for inspecting a discharge failure of discharge nozzles in the functional droplet discharge head and a discharge amount inspection for inspecting an amount of the functional liquid discharged from the discharge nozzles, the control unit being configured to perform a first inspection discharge on the inspection sheet for inspecting the discharge failure and a second inspection discharge on the inspection sheet for inspecting the discharged amount, and then to perform image recognition on a discharge result of the first inspection discharge and to perform image recognition on a discharge result of the second discharge inspection.

5. The droplet discharge device according to claim 1, wherein the discharge inspection of the functional droplet discharge head includes a discharge failure inspection for inspecting a discharge failure of discharge nozzles in the functional droplet discharge head, and a discharge amount inspection for inspecting an amount of functional liquid discharged from the discharge nozzles, the inspection stage has a first inspection stage configured and arranged to support a first inspection sheet for receiving droplets discharged during a first inspection discharge for the discharge failure inspection, and a second inspection stage configured and arranged to support a second inspection sheet for receiving droplets discharged during a second inspection discharge for the discharge amount inspection, and the image recognition device has a first image recognition unit configured and arranged to conduct image recognition of the droplets discharged during the first inspection discharge on the first inspection sheet, and a second image recognition unit configured and arranged to conduct image recognition of the droplets discharged during the second inspection discharge on the second inspection sheet.

6. The droplet discharge device according to claim 5, wherein a frequency of replacing the second inspection sheet is set higher than the frequency of replacing the first inspection sheet, the first inspection stage and the second inspection stage are provided in this sequence from the positioning stage along the common movement axis, and the movement mechanism is configured and arranged to move the first inspection stage and the second inspection stage independently of each other.

* * * * *